US010709306B2

(12) United States Patent
Lee

(10) Patent No.: US 10,709,306 B2
(45) Date of Patent: Jul. 14, 2020

(54) CLEANER AND CONTROL METHOD THEREOF

(71) Applicant: LG ELECTRONICS INC., Seoul (KR)

(72) Inventor: Changjun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 195 days.

(21) Appl. No.: 15/235,191

(22) Filed: Aug. 12, 2016

(65) Prior Publication Data

US 2017/0042401 A1 Feb. 16, 2017

(30) Foreign Application Priority Data

Aug. 12, 2015 (KR) ..... 10-2015-0114059

(51) Int. Cl.
*A47L 11/30* (2006.01)
*A47L 11/40* (2006.01)
(Continued)

(52) U.S. Cl.
CPC ..... *A47L 11/302* (2013.01); *A47L 1/02* (2013.01); *A47L 11/085* (2013.01);
(Continued)

(58) Field of Classification Search
CPC ..... A47L 11/30; A47L 11/302; A47L 11/305; A47L 11/307; A47L 11/4013; A47L 11/4016; A47L 11/4019; A47L 11/4022; A47L 11/4027; A47L 11/4038; A47L 11/408; A47L 11/4083; A47L 11/4088; A47L 1/02; A47L 1/15; A47L 11/065;
(Continued)

(56) References Cited

U.S. PATENT DOCUMENTS 2,893,037 A 7/1959 Strong
4,667,364 A * 5/1987 Meili ..... A47L 11/293 15/319
(Continued)

FOREIGN PATENT DOCUMENTS

CN 2817718 9/2006
CN 202341952 7/2012
(Continued)

OTHER PUBLICATIONS

Machine Translation of KR 10-0582285, May 2006. (Year: 2006).*
(Continued)

*Primary Examiner* — David G Cormier
(74) *Attorney, Agent, or Firm* — Fish & Richardson P.C.

(57) ABSTRACT

Provided are a cleaner having a circulation system of collecting water used in damp cloth, filtering the same, and supplying the filtered water to the cloth, and a control method thereof. The cleaner includes a storage unit storing water, a collecting unit intaking water used in a cloth and introducing intaken water to an upper side of the storage unit, a filter unit filtering water collected by the collecting unit, a water supply unit allowing water within the storage unit to flow out from a lower portion of the storage unit so as to be supplied to the cloth, a vacuum motor operated to cause water to be intaken to the storage unit through the collecting unit, and a pump operate to allow water to be transferred through the water supply unit.

17 Claims, 14 Drawing Sheets

(51) Int. Cl.

| | |
|---|---|
| ***A47L 11/08*** | (2006.01) |
| ***A47L 11/202*** | (2006.01) |
| ***A47L 11/206*** | (2006.01) |
| ***A47L 1/02*** | (2006.01) |

(52) U.S. Cl.
CPC ..... *A47L 11/2025* (2013.01); *A47L 11/2065* (2013.01); *A47L 11/4008* (2013.01); *A47L 11/4011* (2013.01); *A47L 11/4013* (2013.01); *A47L 11/4019* (2013.01); *A47L 11/4022* (2013.01); *A47L 11/4027* (2013.01); *A47L 11/4038* (2013.01); *A47L 11/4069* (2013.01); *A47L 11/4083* (2013.01); *A47L 11/4088* (2013.01)

(58) Field of Classification Search
CPC .... A47L 11/085; A47L 11/125; A47L 11/145; A47L 11/16; A47L 11/161; A47L 11/162; A47L 11/1625; A47L 11/164; A47L 11/22; A47L 11/24; A47L 11/26; A47L 11/28; A47L 11/282; A47L 11/283; B08B 1/00; B08B 1/001; B08B 1/002; B08B 1/003; B08B 1/006; B08B 1/04; B08B 3/02; B08B 3/024; B08B 15/04; B08B 2203/0229; B08B 2215/00; E01H 1/053; E01H 1/10; E01H 1/101; E01H 1/103
See application file for complete search history.

(56) References Cited

U.S. PATENT DOCUMENTS

| | | | | |
|---|---|---|---|---|
| 5,331,713 | A * | 7/1994 | Tipton | A47L 11/305 15/320 |
| 5,636,402 | A * | 6/1997 | Kubo | A47L 11/03 15/319 |
| 6,102,052 | A * | 8/2000 | Versteijnen | B08B 9/08 134/100.1 |
| 8,161,595 | B1 | 4/2012 | Wilson | |
| 2005/0235453 | A1 * | 10/2005 | Vankouwenberg | A47L 11/201 15/340.4 |
| 2006/0027253 | A1 * | 2/2006 | Kaiser | B08B 3/026 134/94.1 |
| 2010/0192980 | A1 | 8/2010 | Turner | |
| 2012/0233804 | A1 * | 9/2012 | Studebaker | A47L 11/161 15/322 |

FOREIGN PATENT DOCUMENTS

| | | |
|---|---|---|
| CN | 203436286 | 2/2014 |
| DE | 8512858 U | 8/1987 |
| JP | 2005-342420 | 12/2005 |
| KR | 10-0582285 | 5/2006 |
| KR | 10-2014-0146702 | 12/2014 |
| TW | 240442 | 2/1995 |
| TW | 201318592 | 5/2013 |
| TW | M469037 | 1/2014 |
| WO | 20070063452 | 6/2007 |

OTHER PUBLICATIONS

Extended European Search Report in European Application No. 16183860.2-1712, dated Jan. 5, 2017, 7 pages (with English translation).

* cited by examiner

CLEANER AND CONTROL METHOD THEREOF

CROSS-REFERENCE TO RELATED APPLICATION

This application claims the priority benefit of Korean Patent Application No. 10-2015-0114059 filed on Aug. 12, 2015 in the Korean Intellectual Property Office, the disclosure of which is incorporated herein by reference.

1. Field

The present disclosure relates to a cleaner having both damp cloth and vacuum cleaning functions and a control method thereof, and particularly, to a cleaner having a circulation system of collecting water used in damp cloth, filtering the same, and supplying the filtered water to the cloth, and a control method thereof.

2. Discussion of the Related Art

In a vacuum cleaner, a fan based on a vacuum motor is installed in a main body to suck dust, filth, or rubbish present on a floor of an indoor area. Also, a related art cleaner includes a system for automatically supplying water to damp cloth and collecting water therefrom, and the dump cloth is automatically moved to clean the floor.

The related art cleaner includes a water supply unit supplying water to a dump cloth, a driving unit moving the dump cloth, and a collecting unit collecting water used in the dump cloth. In particular, when the driving unit rotates the dump cloth, the water supply unit supplies water to the center of the damp cloth to allow water to be spread to the entire damp cloth by centrifugal force and causes water used in the damp cloth to be introduced to the collecting unit by centrifugal force.

The related art cleaner includes a water supply tank storing water to be supplied through the water supply unit and a waste water tank storing contaminated water collected through the collecting unit.

SUMMARY

Provided are a cleaner having a circulation system of collecting water used in damp cloth, filtering the same, and supplying the filtered water to the cloth, and a control method thereof. The cleaner includes a storage unit storing water, a collecting unit intaking water used in a cloth and introducing intaken water to an upper side of the storage unit, a filter unit filtering water collected by the collecting unit, a water supply unit allowing water within the storage unit to flow out from a lower portion of the storage unit so as to be supplied to the cloth, a vacuum motor operated to cause water to be intaken to the storage unit through the collecting unit, and a pump operate to allow water to be transferred through the water supply unit.

According to an innovative aspect of the subject matter described in this application, a cleaner includes a rotary plate; a cloth that is attached to a bottom of the rotary plate and that is configured to receive water; a rotation driving unit that is connected to an upper portion of the rotary plate and that is configured to rotate the rotary plate about an axis that is perpendicular to the rotary plate; a storage unit that is configured to store water, a collecting unit that is configured to collect water from the cloth and that is configured to provide water to an upper side of the storage unit; a filter unit that is configured to filter water that is collected by the collecting unit; a water supply unit that is configured to receive water from a lower portion of the storage unit and that is configured to provide water to the cloth; a vacuum motor that is configured to move water from the storage unit through the collecting unit; and a pump that is configured to move water through the water supply unit.

The cleaner may include one or more of the following features. The water supply unit includes a main pipe that is connected to the storage unit and that is configured to guide water from the storage unit to a center of the rotary plate; and a dispersion pipe that is connected to the main pipe, that is parallel to the rotary plate, that is configured to disperse water received from the main pipe along concentric circles that share a common center at the center of the rotary plate, and that defines a plurality of dispersion holes. The rotary plate defines a plurality of supply holes that are configured to supply water to the cloth. The dispersion pipe is located inside the rotary plate. The rotary plate defines a space that is configured to allow rotation of the dispersion pipe and includes a rotational shaft that is perpendicular to the rotary plate, that is located on an upper portion of the rotary plate, that defines a through hole, and that is configured to receive the main pipe. The plurality of supply holes are located in a lower portion of the rotary plate and are configured to communicate with the space. The water supply unit include additional dispersion pipes that are each connected to the main pipe, that are each rotationally symmetrical to the dispersion pipe, and that each define a same angle between adjacent dispersion pipes.

The plurality of supply holes are located along lines that radiate from the center of the rotary plate. A density of the plurality of supply holes decreases as a distance from the center of the rotary plate increases. The collecting unit includes an outer partition that is located around a circumference of the rotary plate; an inner partition that is located between the circumference of the rotary plate and the outer portion; an intake that is located at the outer partition and that is configured to draw water into a gap that is located between the outer portion and the inner portion; and a collecting pipe that is configured to guide water that is received through the intake to the to the storage unit. The filter unit is located within the storage unit and between the collecting unit and the water supply unit. The storage unit is configured to provide access to the filter unit through an openable structure. The filter unit is located within the storage unit and between the collecting unit and the water supply unit, and is removable from the storage unit. The filter unit is located within the storage unit and between the collecting unit and the water supply unit, and includes a filter net that is configured to collect foreign objects in water and a filter frame that is configured to support the filter net.

The filter net is concave with respect to a top of the filter unit. The filter unit includes a filter net that is configured to collect foreign objects in water and a filter frame that is configured to support the filter net. The storage unit further includes a guide rail that is configured to support the filter frame is located on an inner surface of the storage unit. The filter unit is removable from the storage unit. The guide rail is configured to guide and support the filter frame. The cleaner includes a first water level sensor that is configured to sense a water level within the storage unit and that is configured to transmit a first signal based on the water level being equal to or higher than a first predetermined reference; and a controller that is configured to control the vacuum motor and the pump and that is configured to stop the vacuum motor and the pump in response to receiving the first signal. The first predetermined reference is a water level that is lower than a connection point of the storage unit and the collecting unit. The cleaner includes a second water level sensor that is configured to sense a water level within the storage unit, and that is configured to transmit a second signal based on the water level being lower than a second predetermined reference; a notification unit that is configured to output information from the cleaner, and a controller that is configured to control the notification unit to output water shortage information in response to receiving the second signal.

The cleaner includes a weight sensor that is configured to sense a weight of water within the storage unit and that is configured to transmit a third signal based on the weight being equal to or greater than a third predetermined reference; and a controller that is configured to control the vacuum motor and the pump and that is configured to stop the vacuum motor and the pump in response to receiving the third signal. The cleaner includes a weight sensor that is configured to sense a weight of water within the storage unit, and that is configured to transmit a fourth signal based on the weight being lower than a fourth predetermined reference; a notification unit that is configured to output information from the cleaner; and a controller that is configured to control the notification unit to output water shortage information in response to receiving the fourth signal. The vacuum motor is located on an upper portion of the storage unit. The storage unit includes an intake hole that is configured to communicate with the vacuum motor, a first partition that covers the intake hole and that extends from an inside side wall of the storage unit toward an inside upper wall of the storage unit, and a second partition that covers the first partition, that extends from the inside upper wall toward the inside side wall of the storage unit, and that defines a gap with the inside side wall.

According to another innovative aspect of the subject matter described in this application, a method for controlling a cleaner that includes a cloth, a storage unit that is configured to store water, a water supply unit that is configured to supply water from the storage unit to the cloth, and a collecting unit that is configured to collect water from the cloth and provide water to the storage unit, includes the actions of activating the cleaner, sensing a water level within the storage unit; determining whether the sensed water level is equal to or higher than a first predetermined reference; and based on the sensed water level being equal to or higher than the first predetermined reference, deactivating the cleaner, and based on the sensed water level being lower than the first predetermined reference, continuing to operate the cleaner.

According to another innovative aspect of the subject matter described in this application, a method for controlling a cleaner that includes a cloth, a storage unit that is configured to store water, a water supply unit that is configured to supply water from the storage unit to the cloth, and a collecting unit that is configured to collect water from the cloth and provide water to the storage unit, includes the actions of activating the cleaner; sensing a weight of water within the storage unit; determining whether the sensed weight is equal to or greater than a third predetermined reference; and based on the sensed weight being equal to or greater than the third predetermined reference, deactivating the cleaner, and based on the sensed weight being lower than the third predetermined reference, continuing to operate the cleaner.

According to another innovative aspect of the subject matter described in this application, a method for controlling a cleaner that includes a cloth, a storage unit that is configured to store water, a water supply unit that is configured to supply water from the storage unit to the cloth, and a collecting unit that is configured to collect water from the cloth and provide water to the storage unit, includes the actions of activating the cleaner, sensing a water level within the storage unit; determining whether the sensed water level is equal to or higher than a first predetermined reference; sensing a weight of water within the storage unit; determining whether the sensed weight is equal to or greater than a third predetermined reference; and based on the sensed water level being equal to or higher than the first predetermined reference and based on the sensed weight being equal to or greater than the third predetermined reference, deactivating the cleaner, and based on the sensed water level being lower than the first predetermined reference or based on the sensed weight being lower than the third predetermined reference, continuing to operate the cleaner.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION

Advantages and features of the present disclosure and implementation methods thereof will be clarified through following exemplary embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present invention is only defined by scopes of claims. Throughout the specification, like numbers refer to like elements.

A cleaner according to an embodiment may be utilized to perform damp cloth cleaning and vacuum suction cleaning on a floor, a wall, or a window and may be a portable small device or a large device. In the disclosure, "cloth" may have a meaning including various materials and structures that can be employed by a person skilled in the art, such as brush or a rag. The cloth may be fixedly coupled to the cleaner or may be detachably coupled to the cleaner.

Figure 1:
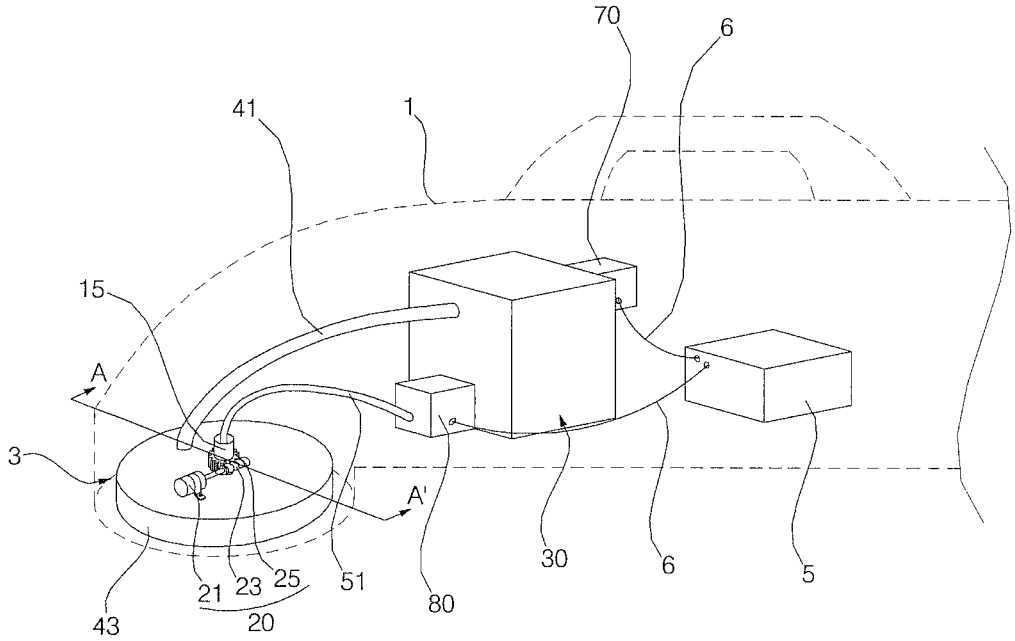
FIG. 1 is a perspective view illustrating an internal configuration without a casing in a cleaner according to an embodiment.

Hereinafter, an embodiment of a cleaner which is portable and has cloth using water attached thereto will be mainly described. FIG. 1 is a perspective view illustrating an internal configuration of a cleaner in which a casing 1 is indicated by the dotted line according to an embodiment.

Hereinafter, words such as 'first, second, third, and forth' written in front of components such as 'partition, signal, and predetermined reference' are used to distinguish the components regardless of a priority.

Referring to FIG. 1, the cleaner includes the casing 1 forming an appearance, a cloth 9 wetted with water so as to be used, and a rotary plate 10 allowing the cloth 9 to be fixed to a lower side thereof. The cloth 9 is attached to a bottom of the rotary plate 10 and is configured to receive water. The rotary plate 10 is installed to be rotatable in a horizontal direction. That is, the rotary plate 10 is installed to be rotatable in a direction parallel to a lower surface thereof to which the cloth 9 is fixed.

The casing 1 forms an appearance of the device and provides a space for accommodating various components therein. The rotary plate 10 and the cloth 9 are disposed in a front portion of the casing 1, and here, the portion is defined as a head part 3. The cloth 9 is fixed to the head part 3 such that a cloth surface is dispose to face downwardly.

The cleaner includes a rotation driving unit 20 installed on an upper side of the rotary plate 10 and rotating the rotary plate 10. The rotation driving unit 20 is connected to an upper portion of the rotary plate 10. The rotation driving unit 20 is configured to rotate the rotary plate 10 about an axis that is perpendicular to the rotary plate 10. The cleaner includes a storage unit 30 storing water to be used in the cloth 9 and to be re-supplied to the cloth 9, a collecting unit 40 intaking water used in the cloth 9 from a circumference of the rotary plate 10 and introducing the intaken water to an upper side of the storage unit 30, and a water supply unit 50 causing water within the storage unit 30 to flow out from a lower portion of the storage unit 30 so as to be supplied to the cloth 9.

The storage unit 30 is configured to store water. The collecting unit 40 is configured to collect water from the cloth 9 and to provide water to an upper side of the storage unit 30. The water supply unit 50 is configured to receive water from a lower portion of the storage unit 30 and to provide water to the cloth 9.

The cleaner includes a filter unit 60 filtering water collected by the collecting unit 40. The filter unit 60 is configured to filter water that is collected by the collecting unit 40. The filter unit 60 may be disposed in the collecting unit 40, but in the present disclosure, the filter unit 60 is disposed within the storage unit 30. Filtering performed by the filtering unit 60 may include a chemical purification scheme or a physical filtering scheme based on a filter net. In this embodiment, the physical filtering scheme will be largely described.

The cleaner includes a vacuum motor 70 installed on an upper portion of the storage unit 30 and operating to allow water to be intaken to the storage unit 30 through the collecting unit 40 and a pump 80 installed on a lower portion of the storage unit 30 and operating to allow water to be transferred through the water supply unit 50. The vacuum motor 70 is located on an upper portion of the storage unit 30. The vacuum motor 70 is configured to move water from the storage unit 30 through the collecting unit 40. The pump 80 is configured to move water through the water supply unit 50.

The cleaner includes a battery 5 supplying electric power to the rotation driving unit 20, the vacuum motor 70, and the pump 80 through a power connection line 6. The cleaner includes a power switch (not shown) allowing a user to turn on or off power and an input unit (not shown) for inputting various manual operations. The cleaner includes a notification unit that includes a speaker for outputting sound or a display for outputting visual information in order to inform the user about an operational state and a malfunction/error state of the device. The cleaner may include a controller 7 controlling operations of various driving devices 21, 70, and 80 and a degree of operations of the driving devices 21, 70, and 80 and controlling output of the notification unit, upon receiving signals from various sensors 91, 92, and 95, and the input unit.

Figure 2:
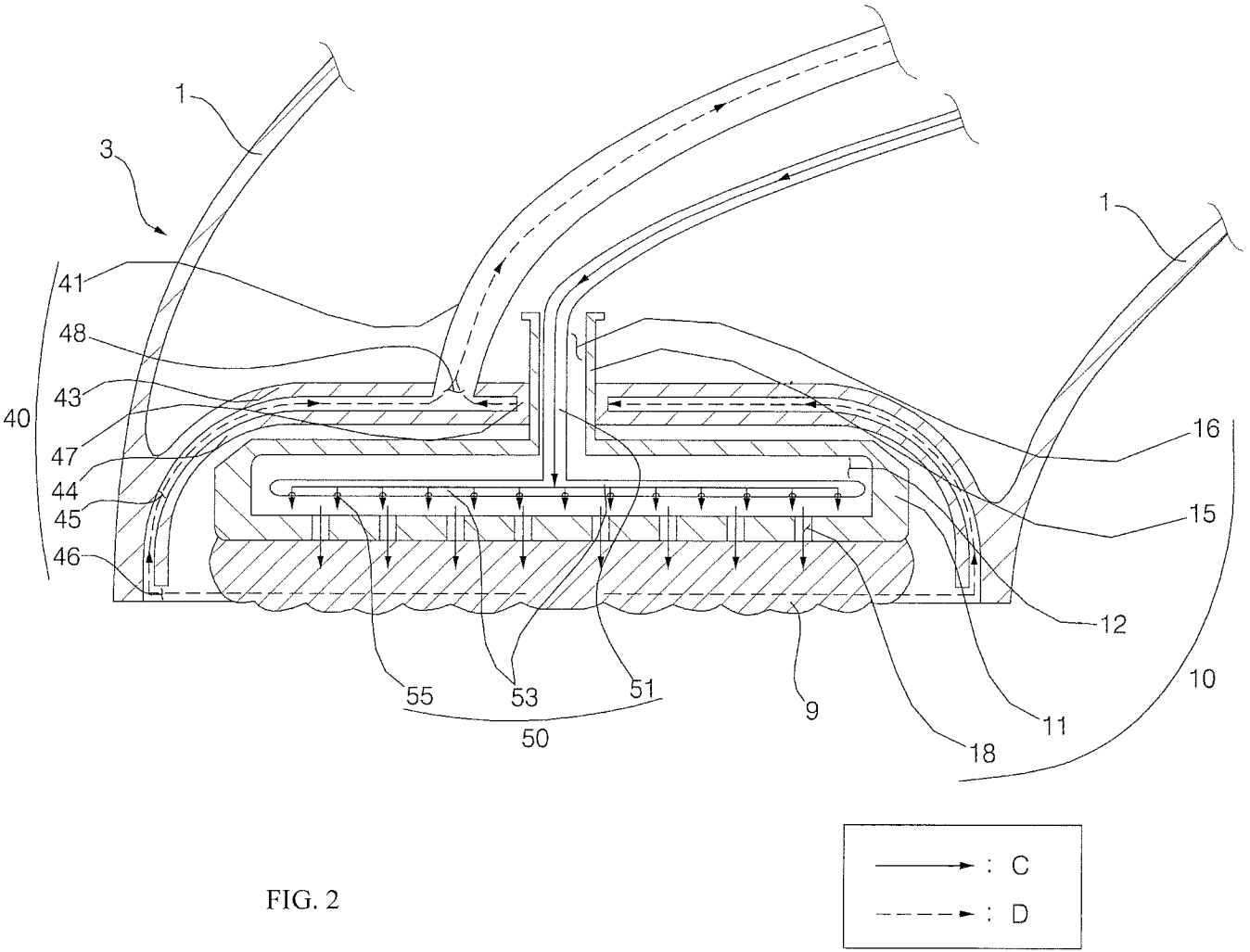
FIG. 2 is a cross-sectional view of a head part of FIG. 1, vertically taken along line A-A', in which a rotation driving unit is indicated by the dotted lines.

FIG. 2 is a cross-sectional view of the head part 3 of FIG. 1 without the rotation driving unit 20, vertically taken along line A-A'. Referring to FIG. 2, the head part 3 forms a space depressed upwardly from a lower surface thereof overall, and the rotary plate 10 and the cloth 9 fixed to the rotary plate 10 are disposed in the depressed space. The cloth 9 is disposed in a lower portion of the head part such that a lower surface thereof contacts the floor when the depressed space of the head part 3 faces in a floor direction and edges of the head part contact the floor.

The water supply unit 50 includes a main pipe 51 connected to the storage unit 30 in one end thereof and guiding water from the storage unit 30 to the center of the rotary plate 10. The main pipe that 51 is connected to the storage unit. The main pipe that 51 is configured to guide water from the storage unit 30 to a center of the rotary plate 10. The pump 80 is disposed on the main pipe 51. When one end of the main pipe 51 is connected to the storage unit 30, it may mean that the pump 80 is directly connected to the storage unit 30 and the main pipe 51 is connected to the pump 80. The main pipe 51 may be formed of various materials, and here, the main pipe 51 may be formed of a rigid metal or a synthetic resin material in order not to interfere with a rotational movement of the rotary plate 10.

The water supply unit 50 includes a dispersion pipe 53 connected to the other end of the main pipe 51 and forming continuous piping. The dispersion pipe 53 extends in a diameter direction of the rotary plate 10. The dispersion pipe 53 disperses water guided by the main pipe 51 in the diameter direction of the rotary plate 10. The dispersion pipe 53 may extend within the rotary plate 10. The dispersion pipe 53 may extend in a diameter direction within the rotary plate 10 and disperse water guided from the main pipe 51 in the diameter direction of the rotary plate 10. The other end of the dispersion pipe 53 is closed. The dispersion pipe 53 is supported by a connection point with the main pipe 51. The dispersion pipe 53 is formed of a material such as a rigid metal or a synthetic resin material allowing a form to be fixed.

The dispersion pipe 53 is connected to the main pipe 51. The dispersion pipe 53 is parallel to the rotary plate 10. The dispersion pipe 53 is configured to disperse water received from the main pipe 51 along concentric circles that share a common center at the center of the rotary plate 10. The dispersion pipe 53 is located inside the rotary plate 10. The water supply unit 50 includes a plurality of dispersing holes 55 formed along the dispersion pipe 53. The dispersion pipe 53 defines the plurality of dispersion holes 53. The dispersion holes 55 may be formed on a side surface or an upper surface of the dispersion pipe 53. In this embodiment, the dispersion holes 55 are provided on a lower surface of the dispersion pipe 53 to allow water from the dispersion pipe 53 to flow downwardly. The plurality of dispersion holes 55 may be formed to be spaced apart from each other at a predetermined interval.

A space 12 may be provided along a relative movement trace of the dispersion pipe 533 according to a rotational movement of the rotary plate 10 within the rotary plate 10. Also, a rotational shaft 15 having a through hole 16 communicating with the space 12 in an axial direction to allow the main pipe 51 to be drawn to a central inner side thereof may be provided in an upper portion of the rotary plate 10. A plurality of supply holes 18 are provided in a penetrating manner vertically to supply water to the cloth 9 in the rotary plate 10. The plurality of supply holes formed in a lower portion of the rotary plate 10 and communicate with the space 12 such that water may be supplied to the cloth 9. The plurality of supply holes 18 are provided in a lower portion of the rotary plate 10 and communicate with the space 12. The plurality of supply holes 18 are located in a lower portion of the rotary plate 10 and are configured to communicate with the space 12.

The rotary plate 10 defines the plurality of supply holes 18 that are configured to supply water to the cloth 9. The rotary plate 10 defines the space 12 that is configured to allow rotation of the dispersion pipe 53. The rotary plate 10 includes the rotational shaft 15 that is perpendicular to the rotary plate 10, that is located on an upper portion of the rotary plate 10, that defines the through hole 16, and that is configured to receive the main pipe 51.

The rotary plate 10 includes a rotary plate main body 11 having a cylindrical shape overall and the tubular rotational shaft 15 disposed on an upper side of the rotary plate main body 11. An upper corner of the rotary plate main body 11 has a chamfered shape. On the inner side of the rotary plate main body 11, the cylindrical space 12 having a height and a diameter lower than those of the external cylindrical shape of the rotary plate main body 11 is provided.

The space 12 may accommodate the dispersion pipe 53, and the dispersion pipe 53 is disposed to be spaced apart from the space 12. When the rotary plate main body 11 rotates centered on the rotational shaft 15, the space 12 is also rotated together. The dispersion pipe 53 is an element separated from the rotary plate 10, and thus, when the rotary plate main body 11 is rotates, the dispersion pipe 53 stays fixedly in a position. Thus, the dispersion pipe 53 within the space 12 draws a relative rotational movement trace with respect to the space 12 and an inner surface of the space 12 is spaced apart from the relative rotational movement trace of the dispersion pipe 53. Accordingly, with the dispersion pipe 53 fixed, water may be dispersed to the entirety of the rotary plate and the rotary plate 10 that makes a rotational movement and the fixed dispersion pipe 53 may not interfere with each other.

The rotational shaft 15 having the through hole 16 in an axial direction is provided on an upper surface of the rotary plate main body 11. The rotational shaft 15 may be formed at the center of the upper surface of the rotary plate main body 11. The through hole 16 is formed such that the exterior and the space 12 communicate with each other in an axial direction of the rotary shaft. The main pipe 51 is drawn to the center of the space 12 through the through hole 16 from the outside. The other end of the main pipe 51 is positioned at the center of the space 12. The dispersion pipe 53 is connected to the other end of the remote flow plate 51. Accordingly, the rotary plate 10 and the rotational shaft 15 make a rotational movement, and even when the main pipe 51 stays in a fixed state, the rotational shaft 15 and the main pipe 51 are disposed not to interfere with each other.

Although not shown in FIG. 2, in another embodiment, a gasket (not shown) may be provided between an inner surface of the through hole 16 and an outer surface of the main pipe 51 passing through the through hole 16 in order to prevent water within the space 12 from being released to the through hole 16 when the device is reversed. Since the main pipe 51 is fixed even when the rotary plate 10 rotates, the gasket may include a slidable side such that the outer surface of the main pipe 51 and the inner surface of the through hole 16 do not restrain from each other. Accordingly, even when the rotational shaft 15 rotates, the main pipe 51 may be fixed and outflow of water from the interior of the space 12 through the through hole 16 may be prevented.

In FIG. 2, the arrows C indicates a flow direction of supplied water. When the pump 80 operates, water moves to the center of the space of the rotary plate main body 11 through the main pipe 51. Such water moves in a diameter direction of the rotary plate 10 through the dispersion pipe 53 connected to the main pipe 51. Water moving along the dispersion pipe 53 flows out through the plurality of dispersion holes 55 so as to be positioned between the dispersion pipe 53 and the inner surface of the space 12. Water moves to a lower side of the space 12 according to gravitation. The water moves to the cloth 9 fixed to the lower surface of the rotary plate main body 11 through the plurality of supply holes 18. Accordingly, clean water may be supplied to the entire area of the cloth 9.

The collecting unit 40 includes an outer partition 43 disposed along a circumference of the rotary plate 10 and an inner partition 44 disposed to form a gap 45 allowing water to be intaken to an inner side along the outer partition 43. The outer partition 43 is located around a circumference of the rotary plate 10. The inner partition 44 is located between the circumference of the rotary plate 10 and the outer portion 43. The collecting unit 40 includes an intake 48 formed in the outer partition 43 to allow water to be intaken and a collecting pipe 41 guiding water intaken through the intake 48 to the storage unit 30. The intake 48 is located at the outer partition 43 and is configured to draw water into a gap that is located between the outer portion 43 and the inner portion 41. The collecting pipe 41 is connected to the storage unit 30 on one end thereof and connected to the intake 48 on the other end thereof. The collecting pipe 41 is configured to guide water that is received through the intake 48 to the to the storage unit 30.

The outer partition 43 may have a rounded hemispherical shape along the depressed space of the head part 3, may have an angular funnel shape, or may have a truncated conic shape or a cylindrical shape. A lower end of the outer partition 43 contacts the floor together with the cloth 9 when cleaning is performed.

The inner partition 44 is disposed to form a gap 45 between the partition along the outer partition 43. One surface of the inner partition 44 forms a side sectioning the depressed space of the head part 3, and the opposite surface of the one surface faces the outer partition 43. The opposite surface of the inner partition 44 and the inner surface of the outer partition 43 are spaced from each other in a facing manner to form a gap 45 between the partitions. The inner partition 44 may have a rounded hemispherical shape along the depressed space of the head part 3, may have an angular funnel shape, or may have a truncated conic shape or a cylindrical shape, according to the shape of the outer partition 43.

A lower end of the inner partition 44 is disposed in a position higher than the lower end of the outer partition 43. Due to the difference in height between the lower end of the inner partition 44 and the lower end of the outer partition 433, when the outer partition 43 contacts the floor, an intake gap 46 is formed between the floor and the lower end of the inner partition 44.

At least one intake 48 is formed above the outer partition 43. The gap 45 between the partitions and the collecting pipe 41 and the collecting pipe 41 communicate with each other through the intake 48. The rotational shaft 15 of the rotary plate 10 penetrate through a central portion of the outer partition 43 and the inner partition 44 in a vertical direction. In order to prevent the gap 45 between the partitions from communicating with the portion penetrated by the rotational shaft 15, a connection partition 47 connecting the outer partition 43 and the inner partition 44 in a vertical direction along a circumference of the rotational shaft 15 is provided in the gap 45 between the partitions. The connection partition 47 has a circular tubular shape and has a lower end coupled to the inner partition 43 and an upper end coupled to the outer partition 43. A length of an inner diameter of the connection partition 47 is equal to or slightly greater than a length of an outer diameter of the rotational shaft 15. The intake 48 is provided in a position deviating from a central portion of the outer partition 43 so as not to overlap the position of the rotational shaft 15.

In FIG. 2, the arrows D indicates a flow direction of collected water. When the rotation driving unit 20 operates, water moves to the cloth 9 or toward the edge of the cloth 9 through the bottom surface according to centrifugal force based on the rotational movement of the rotary plate 10 and the cloth 9. Also, the water moves to the gap 45 between the partitions through the intake gap 46. Also, the water moves to the intake 48 along the gap 45 between the partitions. Also, the water is introduced to the collecting pipe 41 through the intake 48 and moves to the storage unit 30 along the collecting pipe 41. Accordingly, contaminated water may be intaken through the entire circumference of the cloth 9.

Figure 3:
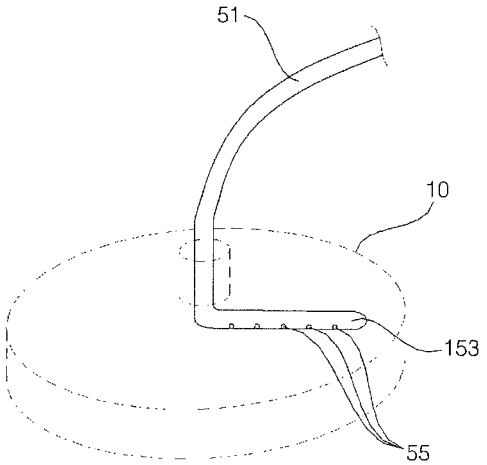
FIG. 3 is a perspective view illustrating a structure of a dispersion pipe and a rotary plate indicated the dotted line according to a first embodiment.
Figure 4:
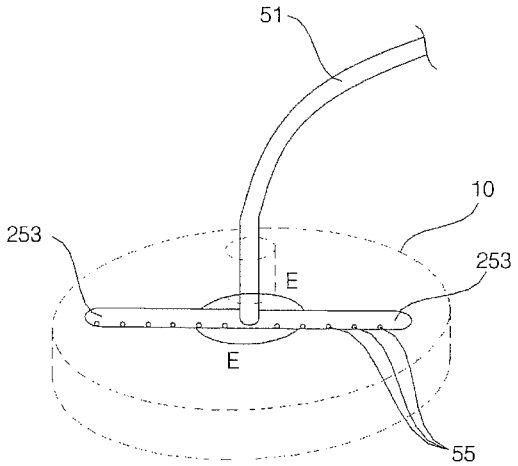
FIG. 4 is a perspective view illustrating a structure of a dispersion pipe and a rotary plate indicated the dotted line according to a second embodiment.
Figure 5:
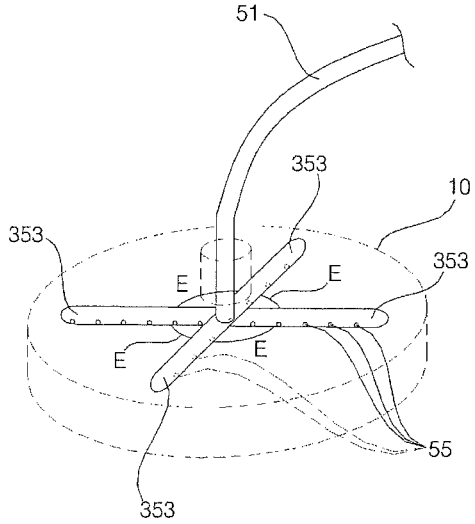
FIG. 5 is a perspective view illustrating a structure of a dispersion pipe and a rotary plate indicated the dotted line according to a third embodiment.

Hereinafter, embodiments according to a structure of the dispersion pipe 53 will be described with reference to FIGS. 3 to 5. FIG. 3 is a perspective view illustrating a structure of a dispersion pipe 153 according to a first embodiment, FIG. 4 is a perspective view illustrating a structure of a dispersion pipe 253 according to a second embodiment, and FIG. 5 is a perspective view illustrating a structure of a dispersion pipe 353 according to a third embodiment.

In the first embodiment, one dispersion pipe 153 is provided. The dispersion pipe 153 extends in any one of diameter directions of the rotary plate 10, from the other end of the main pipe 51. A plurality of dispersion holes 55 are formed along the dispersion pipe 153. Since the rotary plate 10 makes a rotational movement, water may be dispersed and supplied to the entire bottom surface of the space 12 within the rotary plate even by the single dispersion pipe 153.

The dispersion pipe 153 may be branched from the main pipe 51 such that a plurality of dispersion pipes form the same angle E of inclination therebetween. In the second embodiment, two dispersion pipes 253 are branched from the main pipe 51 and form an angle of inclination E of 180 degrees therebetween. In the third embodiment, four dispersion pipes 353 are branched from the main pipe 51 and form an angle E of inclination of 90 degrees therebetween. In another embodiment, a plurality of dispersion plates 53 may be branched from the main pipe 51 and form angles of inclination not equal to each other. The water supply unit 50 include additional dispersion pipes 253 that are each connected to the main pipe 51, that are each rotationally symmetrical to the dispersion pipe 253, and that each define a same angle between adjacent dispersion pipes 253.

In the second embodiment, two dispersion pipe 253 are provided. The two dispersion pipes 253 are branched from the other end of the main pipe 51 in the mutually opposite directions. A plurality of dispersion holes 55 are formed along the two dispersion pipes 253. Compared with the first embodiment in which was is supplied to a portion of the bottom surface of the rotary plate 10 once while the rotary plate 10 rotates once, in the second embodiment, water is supplied to a portion of the bottom surface of the rotary plate 10 twice while the rotary plate 10 rotates once. That is, in the second embodiment, the same amount of water may be supplied to the cloth 9 in a divided manner twice while the rotary plate 10 rotates once.

In the third embodiment, four dispersion pipes 353 are provided. The four dispersion pipes 253 are branched from the other end of the main pipe 51 in the mutually opposite directions by twos. A plurality of dispersion holes 55 are formed along the four dispersion pipes 353. Compared with the first embodiment in which was is supplied to a portion of the bottom surface of the rotary plate 10 once while the rotary plate 10 rotates once, in the third embodiment, water is supplied to a portion of the bottom surface of the rotary plate 10 four times while the rotary plate 10 rotates once. That is, in the third embodiment, the same amount of water may be supplied to the cloth 9 in a divided manner four times while the rotary plate 10 rotates once.

Even in a case in which the numbers of dispersion pipes 53 are different in an application example of the second embodiment and the third embodiment, a person in the art may sufficiently anticipate a configuration and effect thereof, and thus, descriptions of other embodiment will be omitted.

The plurality of supply holes 18 are formed on a lower surface of the rotary plate 10. The plurality of supply holes 18 may be evenly arranged on the entire area of the lower surface of the rotary plate or may be arranged with high density in a partial area of the lower surface of the rotary plate 10. The plurality of supply holes 18 may be arranged in a diameter direction of the lower surface of the rotary plate 10. The plurality of supply holes 18 may be arranged to traverse a center of the lower surface of the rotary plate 10. The plurality of supply holes 18 are located along lines that radiate from the center of the rotary plate 10.

Figure 6:
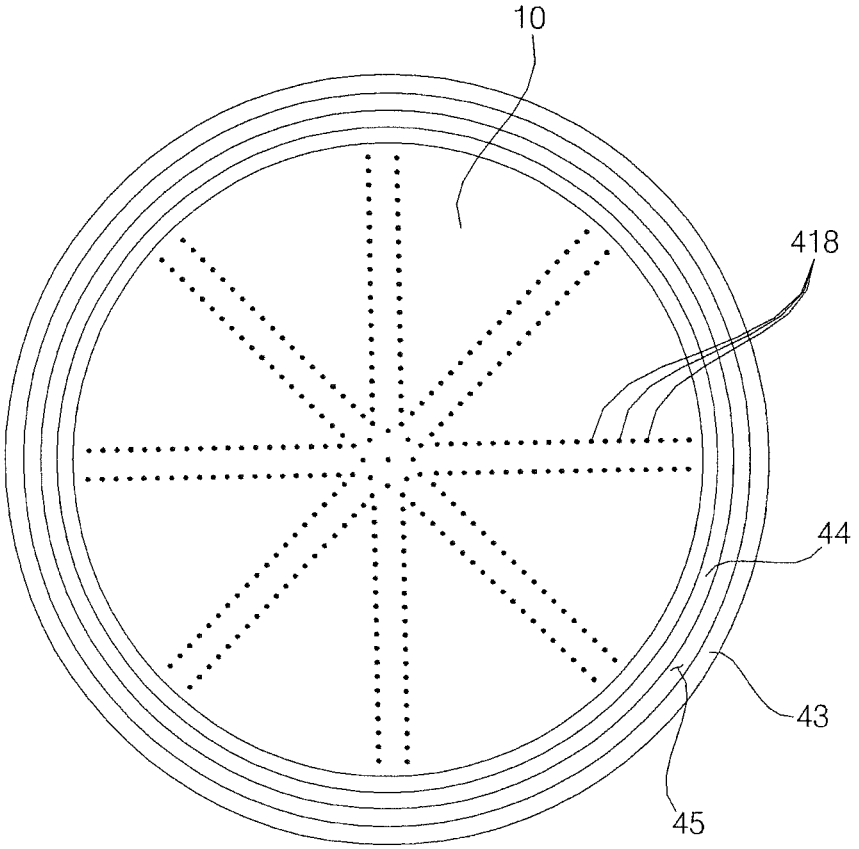
FIG. 6 is a bottom view of a rotary plate in which a plurality of supply holes are arranged, without cloth, according to a fourth embodiment.
Figure 7:
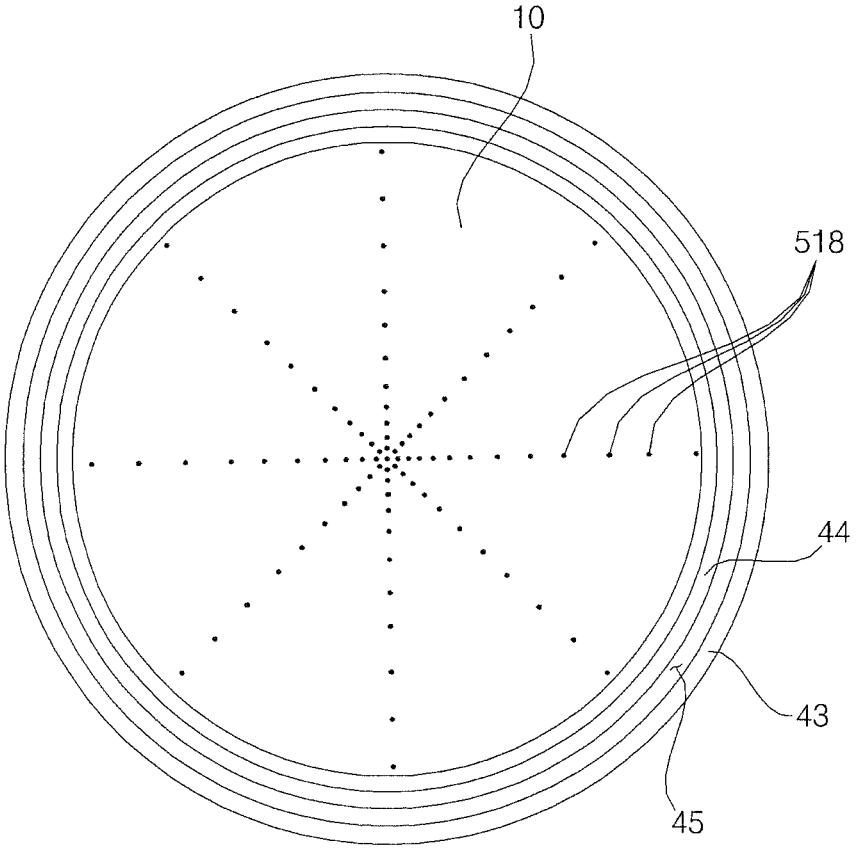
FIG. 7 is a bottom view of a rotary plate in which a plurality of supply holes are arranged, without cloth, according to a fifth embodiment.

Hereinafter, two among various embodiments of arrangement of a plurality of supply holes 18 will be described. FIG. 6 is a bottom view of the rotary plate 10 in which a plurality of supply holes 418 are arranged according to a fourth embodiment, and FIG. 7 is a bottom view of the rotary plate 10 in which a plurality of supply holes 518 are arranged according to a fifth embodiment.

In the fourth embodiment, the plurality of supply holes 418 are arranged to be parallel to each other in two rows on a lower surface of the rotary plate 10. A plurality of arrangement groups of the plurality of holes 418 arranged in the two rows may be formed. In this embodiment, four arrangement groups are provided and formed at the same angle of inclination of 45 degrees Accordingly, portions to which water is concentratedly supplied are disposed to be spaced apart from each other at a predetermined interval in a circumferential direction on the lower surface of the rotary plate 10.

In the fifth embodiment, the plurality of supply holes 518 are arranged such that the number of density thereof is decreased in a direction toward an outer side from the center of the lower surface of the rotary plate 10. The density of the plurality of supply holes 518 decreases as a distance from the center of the rotary plate 10 increases. In this embodiment, the plurality of supply holes 518 are formed in a diameter direction of the rotary plate 10, and here, intervals between the plurality of supply holes 518 are gradually decreased in a direction toward the center of the rotary plate 10 and gradually increased in an outward direction of the rotary plate 10. Accordingly, clean water may be supplied to the entire area of the cloth 9 and a larger amount of water may be supplied to the center of the cloth 9. Since water supplied to the center of the cloth 9 may be moved toward a marginal portion (or an edge portion) of the cloth 9 by centrifugal force based on a rotational movement of the rotary plate 10, a less amount of clean water is additionally distributed to be supplied to the marginal portion of the cloth 9, than that supplied to the central portion of the cloth 9 in this embodiment.

Figure 8:
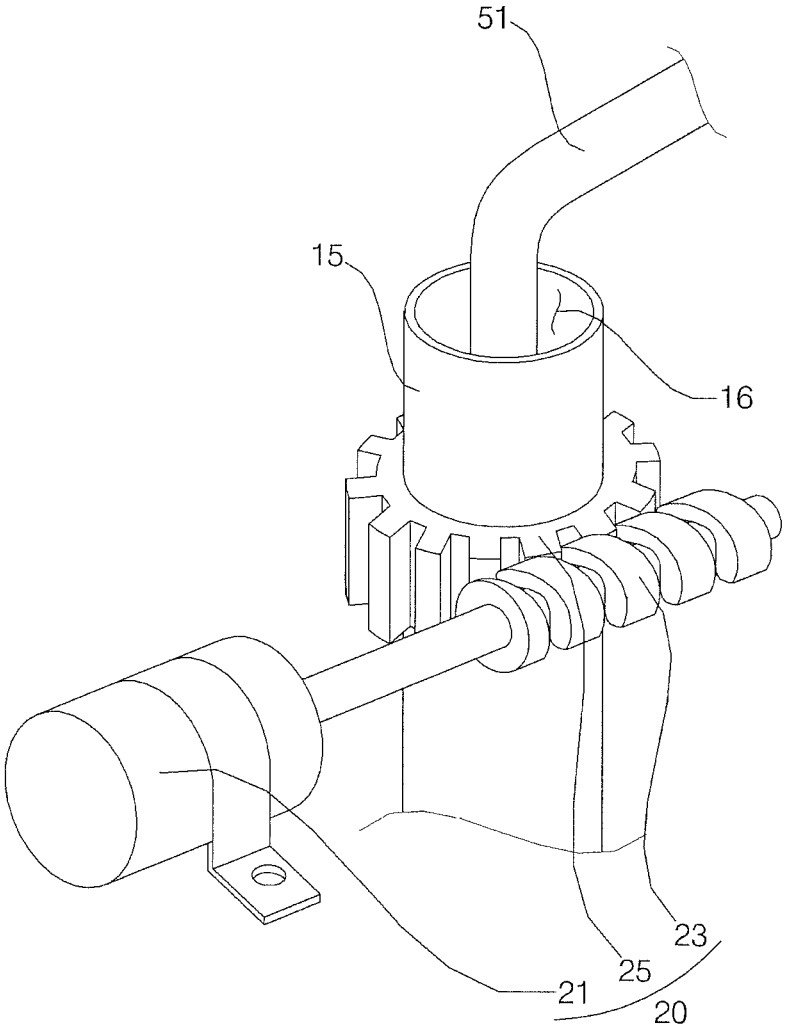
FIG. 8 is an enlarged perspective view of the rotation driving unit of FIG. 1.

FIG. 8 is an enlarged perspective view of the rotation driving unit 20 of FIG. 1. The rotation driving unit 20 includes a rotary motor 21 in which a motor rotational shaft is formed to be horizontal, a worm 23 formed along the motor rotational shaft, and a worm wheel 25 having a disk shape in the vicinity of the rotational shaft 15 and vertically engaged with the worm 23. Accordingly, the motor rotational shaft (not shown) and the rotational shaft 15 cross vertically to transmit power from the rotary motor 21 to the rotational shaft 15.

Figure 9:
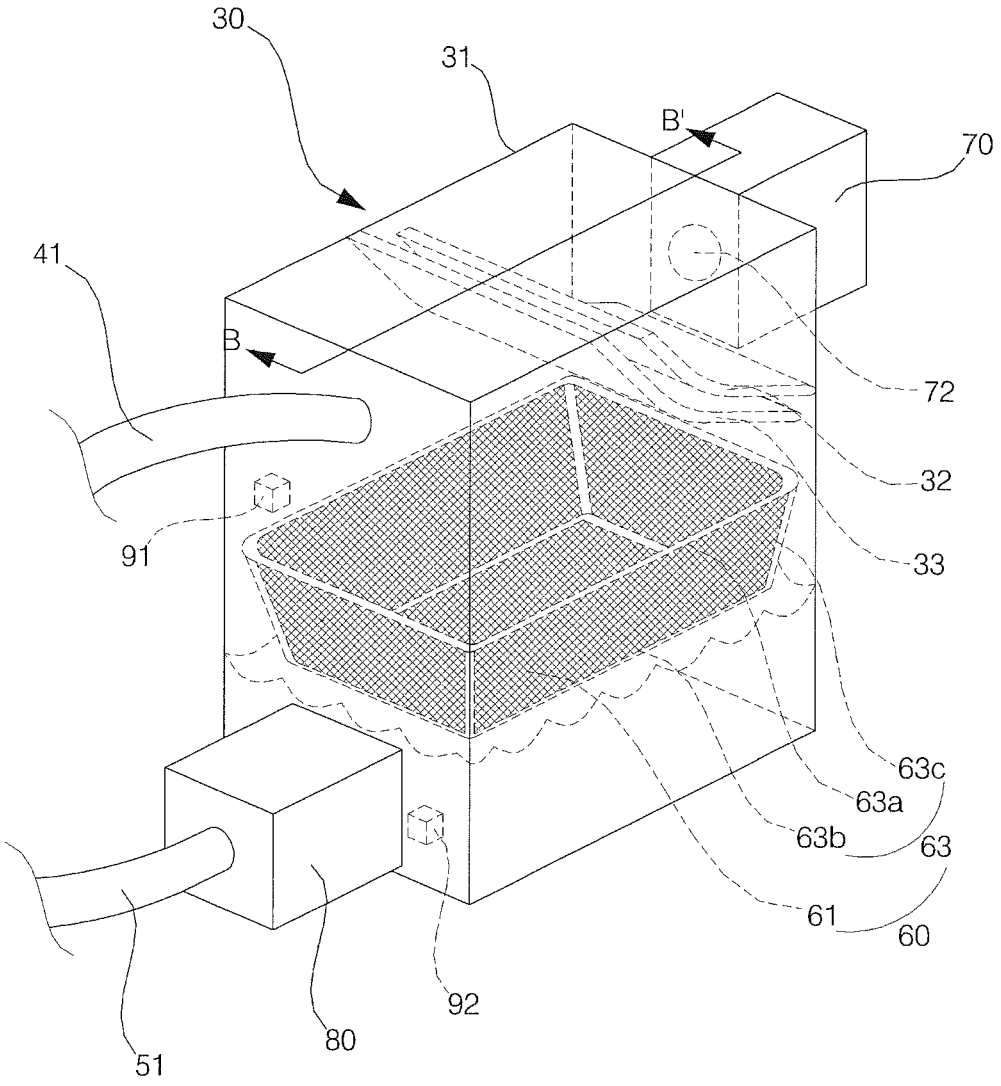
FIG. 9 is a perspective view illustrating an internal configuration in which a storage tank of a storage unit of FIG. 1 is transparently shown and a collecting unit, a water supply unit connected to the storage unit, a filter unit, a vacuum motor, a pump, and various sensors are provided.

Referring to FIG. 9, the filter unit 60 is horizontally disposed within the storage unit 30. FIG. 9 is a perspective view illustrating an internal configuration in which the storage tank 31 of the storage unit 30 of FIG. 1 is transparently shown. The filter unit 60 is located within the storage unit 30 and between the collecting unit 40 and the water supply unit 50. The filter unit 60 is disposed between a connection point of the collecting unit 40 and a connection point of the water supply unit 50 within the storage unit 30. The connection point of the collecting unit 40 means a connection point between the collecting unit 40 and the storage unit 30. The connection point of the water supply unit 50 means a connection point between the water supply unit 50 and the storage unit 30. That is, the filter unit 60 is disposed on a side lower than the point where the storage unit 30 and the collecting pipe 41 are connected so that water introduced to the interior of the storage unit 30 through the collecting pipe 41 passes through the filter unit 60 by gravitation. Also, the filter unit 60 is disposed on a side higher than the point where the storage unit 30 and the main pipe 51 are connected so that water which has passed through the filter unit 60 is accommodated on a lower side of the storage unit 30 or flows out through the main pipe 51.

The filter unit 60 includes a filter net 61 collecting a foreign object included in collected water and a filter frame 63 supporting the filter net 61. The filter net 61 is configured to collect foreign objects in water. The filter frame 63 is configured to support the filter net 61. Also, the filter unit 60 may include a known chemical or physical unit for removing a contaminant included in collected water.

The filter net 61 includes a portion horizontally traversing the storage unit 30. The filter net 61 may have a shape in which a surface thereof is depressed in a downward direction. The filter net 61 is concave with respect to a top of the filter unit 60. Accordingly, a collected foreign object may easily gather in the depressed filter net 61 portion. The filter net 61 may be disposed to have a hexahedral shape without an upper surface. Thus, a foreign object may be easily gather in the lower surface portion of the filter net 61.

The filter frame 63 fixedly support an outer side of the filter net 61 disposed in various shapes. The filter frame 63 is supported by an inner wall of the storage unit 30. The filter frame 63 may have a structure connected to be detachably attached to the inner wall of the storage unit 30.

Figure 11:
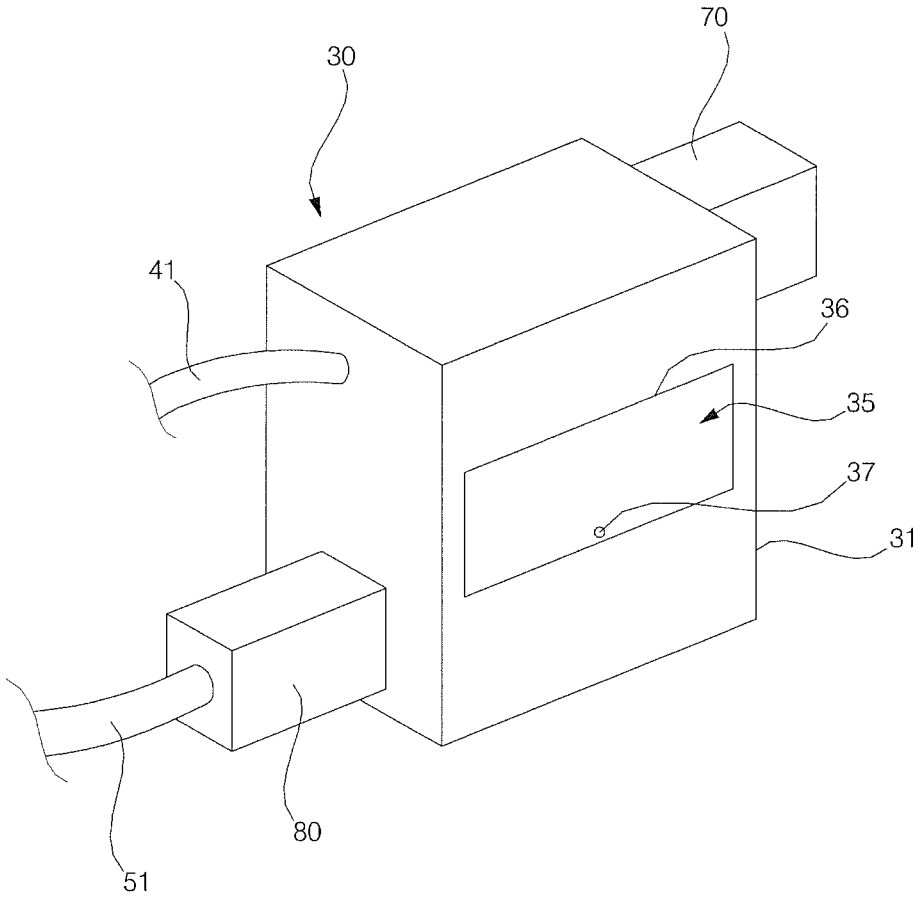
FIG. 11 is a perspective view of a storage unit illustrating a state in which an openable structure of a storage unit according to an embodiment is closed.
Figure 12:
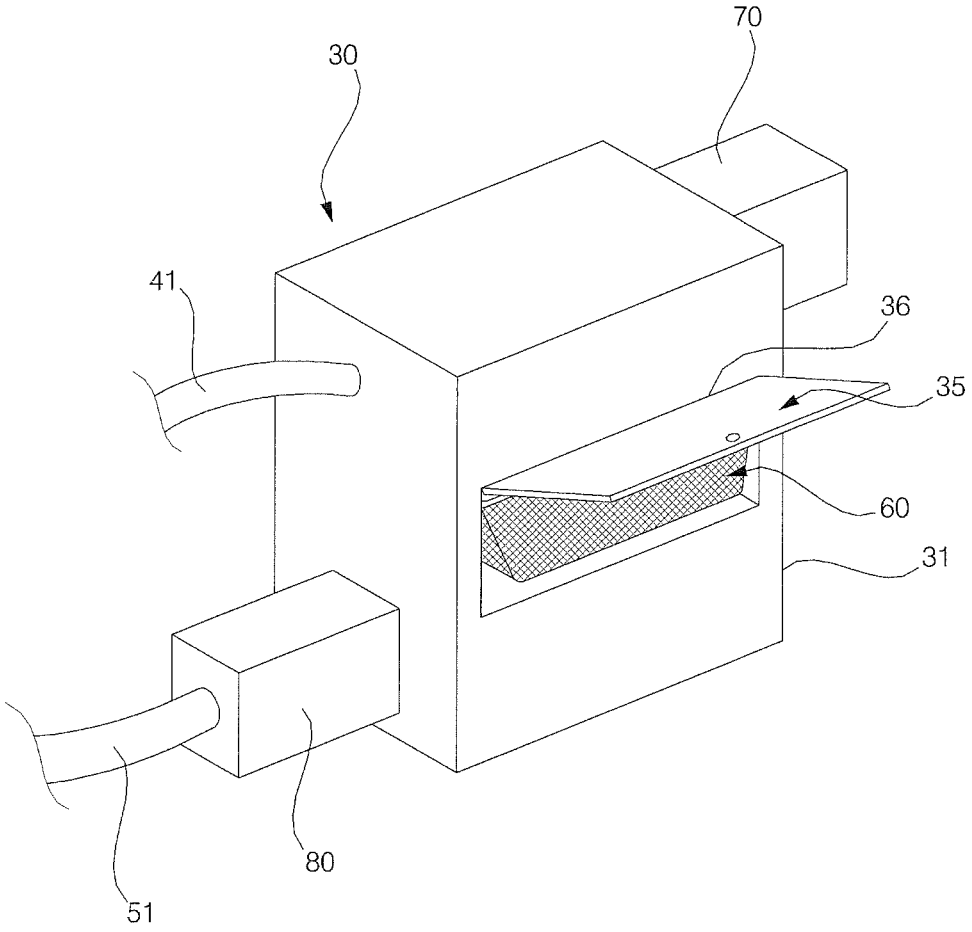
FIG. 12 is a perspective view of a storage unit illustrating a state in which the openable structure of FIG. 11 is open.

Referring to FIGS. 11 and 12, the storage unit 30 may have a structure 35 that can be opened such that the filter unit 60 is exposed outwardly. FIG. 11 is a perspective view of the storage unit 30 illustrating a state in which the openable structure 35 of the storage unit 30 according to an embodiment is closed, and FIG. 12 is a perspective view of the storage unit 30 illustrating a state in which the openable structure 35 of FIG. 11 is open. The storage unit 30 is configured to provide access to the filter unit 60 through the openable structure.

The openable structure 35 may be a hinged structure or a sliding structure. The openable structure 35 may include a hinge 36 allowing a partial external surface of the storage unit 30 is rotated to be opened. The storage unit 30 is configured to provide access to the filter unit 60 through a hinged access panel. The openable structure 35 may include a gasket (not shown) preventing generation of a gap through which water may be leaked in a closed state. The openable structure 35 may include a separation pin 37 for fixing the openable structure 35 such that the openable structure 35 is not opened in a closed state. The openable structure 35 may be opened when a user separates the separation pin 37 from the storage unit 30.

Figure 10:
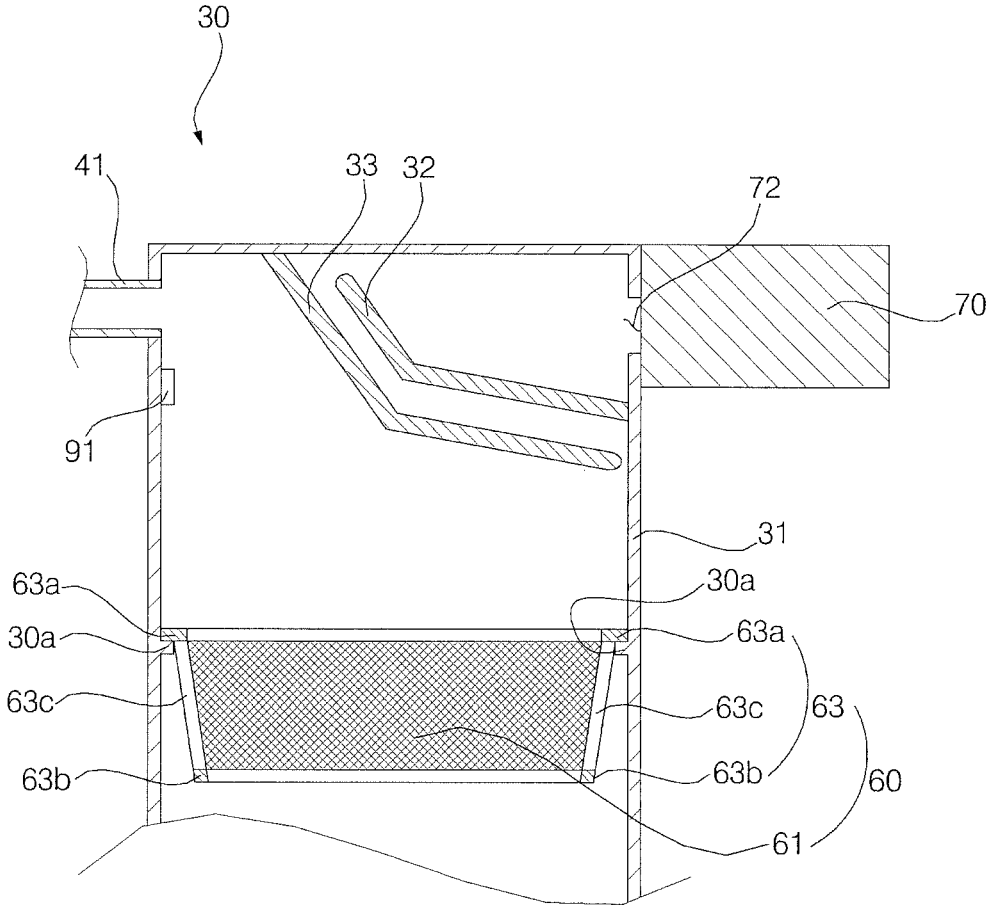
FIG. 10 is a cross-sectional view of the storage unit of FIG. 9, vertically taken along line B-B'.

Referring to FIG. 10, the filter unit 60 may be drawn out and drawn in from the outside of the storage unit 30. the filter unit 60 may be removable from the storage unit 30. The filter frame 63 may include a horizontal frame **63*a* which contacts an inner surface of the storage unit 30 and forms a circumference on a horizontal surface. In this embodiment, the horizontal frame 63*a* forms an upper end of the filter frame 63, but it may also form a lower end of the filter frame 63. The filter frame 63 may include an auxiliary frame 63*b* horizontally formed on the opposite side of the horizontal frame 63*a* among the upper end and the lower end of the filter frame 63. In this embodiment, the auxiliary frame 63*b* is formed at the lower end of the filter frame 63. The auxiliary frame 63*b* is disposed at a circumference of the filter net 61 forming a lower surface of the filter unit 60. The filter frame 63 includes a connection frame 63*c* vertically connecting the horizontal frame 63***a* and the auxiliary frame 63*b*. One end of the connection frame 63*c* is coupled to the horizontal frame 63*a*, and the other end thereof is coupled to the auxiliary frame 63*b*. The connection frame 63*c* is supported by the horizontal frame 63*a*, and the auxiliary frame 63*b* is supported by the connection frame 63*c*. The connection frame 63*c* supports the filter net 61 forming a side surface of the filter unit 60.

A guide rail 30*a* may be formed on an inner surface of the storage unit 30 along the horizontal frame 63*a*. The guide rail 30*a* may protrude from the inner surface of the storage unit 30 or may be depressed from the inner surface of the storage unit 30. The guide rail 30*a* may support the filter frame 63. In detail, the guide rail 30*a* may support the horizontal frame 63*a*. The guide rail 30*a* may movably support the filter frame 63. The guide rail 30*a* may slidably support the filter frame 63. The guide rail 30*a* is configured to guide and support the filter frame 63.

The horizontal frame 63*a* may be drawn out in any one direction of the storage unit 30 along the guide rail 30*a*. In the embodiment in which the openable structure 35 is provided, the filter unit 60 may be drawn in or out through an opening formed on one surface of the storage unit 30 in a state in which the openable structure 35 is opened.

FIG. 10 is a cross-sectional view of the storage unit 30 of FIG. 9, vertically taken along line B-B'. Referring to FIGS. 9 and 10, the storage unit 30 includes an intake hole 72 formed therein at a point where the storage unit 30 is connected to the vacuum motor 70. The intake hole 72 is configured to communicate with the vacuum motor 70.

The storage unit 30 includes a first partition 32 covering the intake hole 72 and extending from an inside side wall of the storage unit 30 toward an inside upper wall of the storage unit 30. The first partition 32 forms a gap with the inside upper wall and air may move between two spaces divided by the first partition 32 through the gap.

The storage unit 30 includes a second partition 33 covering the first partition 32 and extending from the inside upper wall toward the inside side wall. The second partition 33 forms a gap with the inside side wall and air may move between two spaces divided by the second partition 33 through the gap. The second partition 33 defines a gap with the inside side wall.

An upper end of the first partition 32 is spaced apart from the upper surface of the storage unit 30 to form a gap therebetween. A lower end of the first partition 32 is coupled to one of side surfaces of the storage unit 30 in which the intake hole 72 is formed. A lower end of the first partition 32 is coupled to an inner surface of the storage unit 30 below the intake hole 72. Both side ends of the first partition 32 are coupled to the inner surface of the storage unit 30. In another embodiment, both side ends of the first partition 32 may be bent upwardly so as to be coupled to an upper surface of the storage unit 30.

A lower end of the second partition 33 is spaced apart from one of the side surfaces of the storage unit 30 in which the intake hole 72 is formed to form a gap therebetween, and disposed to be spaced apart from the first partition 32 below the first partition to form a gap therebetween. An upper end of the second partition 33 is coupled to the upper surface of the storage unit 30. Both side ends of the second partition 33 are coupled to the inner surface of the storage unit 30. In another embodiment, the both side ends of the second partition 33 may be bent upwardly so as to be coupled to an upper surface of the storage unit 30 or coupled to the first partition 32.

Even though the device slopes forwardly or backwardly, introduction of water to the intake hole 72 may be prevented through the first partition 32 and the second partition 33.

Figure 13:
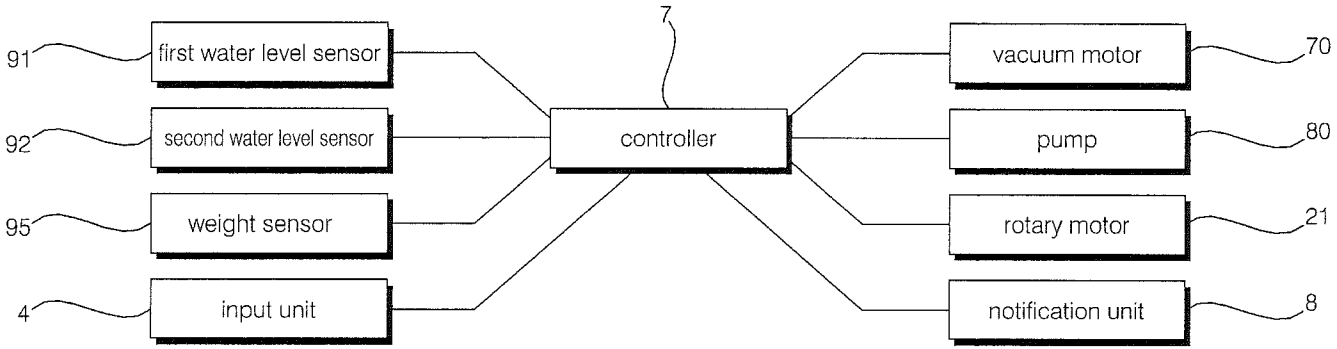
FIG. 13 is a block diagram of a controller receiving a signal from various sensors and an input unit and controlling various devices.

Referring to FIG. 13, the controller 7 receives signals from various sensors 91, 92, and 95 and the input unit 4. The controller 7 controls the notification unit 8, the rotary motor 21, the vacuum motor 70, and the pump 80.

The cleaner may include water level sensors 91 and 92 sensing a water level within the storage unit 30. The water level sensors 91 and 92 may be mechanical sensors including a float (not shown) remaining on a water surface, a bar (not shown) connected to the float in one end thereof, and a hinge 36 provided at the other end of the bar and being rotatable in a vertical direction. The water level sensors 91 and 92 may employ various other schemes that may be implemented by a person skilled in the art.

The cleaner may include a weight sensor 95 sensing a weight of water within the storage unit 30. Sensing a weight of water within the storage unit 30 also includes sensing the sum of a weight of the storage unit 30 having an interior filled with water and a weight of water. A bracket (not shown) may protrude from an inner side of the casing 1 or from a separate support member (not shown) connected to the casing 1 and support the storage unit 30. A weight sensor 95 may be provided to sense a weight when a connection portion of the bracket and the storage unit 30 is deformed. The weight sensor 95 may employ various other schemes that may be implemented by a person skilled in the art.

The cleaner may include a first water level sensor 91 transmitting a first signal when a water level is equal to or higher than a first predetermined reference and the controller 7 controlling the vacuum motor 70 and the pump 80 to be stopped from operation, upon receiving the first signal. In this case, the first predetermined reference may be a water level that is lower than a connection point of the storage unit 30 and the collecting unit 40. Accordingly, in a case in which water excessively rises within the storage unit 30 to flow backwards to the collecting pipe 41 to cause a possibility of malfunction, an operation of the device is stopped to prevent malfunction.

The first water level sensor 91 is configured to sense a water level within the storage unit 30. The first water level sensor 91 is configured to transmit the first signal based on the water level being equal to or higher than the first predetermined reference. The controller 7 is configured to control the vacuum motor 70 and the pump 80 and is configured to stop the vacuum motor 70 and the pump 80 in response to receiving the first signal.

The cleaner may include a second water level sensor 92 transmitting a second signal when a water level is lower than a second predetermined reference and the controller 7 controlling the notification unit 8 to output water quantity shortage information, upon receiving the second signal. In this case, the second predetermined reference may be a water level lower than the first predetermined reference. The second predetermined reference is a water level lower than a point where the filter unit 60 is disposed. The second predetermined reference is a water level higher than a point where the main pipe 51 is connected to a lower portion of the storage unit 30, and when a water level is lowered than the second predetermined reference, water may not be normally supplied. Thus, when a quantity of water within the storage unit 30 is so small that the device cannot be normally operated, the user may be easily informed thereabout.

The second water level sensor 92 is configured to sense a water level within the storage unit 30. The second water level sensor 92 is configured to transmit the second signal based on the water level being lower than the second predetermined reference. The notification unit 8 that is configured to output information from the cleaner. The controller 7 is configured to control the notification unit 8 to output water shortage information in response to receiving the second signal.

The cleaner may include the weight sensor 95 transmitting a third signal when the weight is equal to or grater than a third predetermined reference, and the controller 7 controlling the vacuum motor 70 and the pump 80 to be stopped from operation, upon receiving the third signal. In this case, the third predetermined reference may be a weight when water within the storage unit 30 rises to a water level at which water does not flow backwards to the collecting pipe 41 in a state in which the storage unit 30 is horizontally placed. Accordingly, in a case in which water excessively rises within the storage unit 30 to flow backwards to the collecting pipe 41 to cause a possibility of malfunction, the operation of the device is stopped to prevent malfunction.

The weight sensor 95 is configured to sense a weight of water within the storage unit 30. The weight sensor 95 is configured to transmit the third signal based on the weight being equal to or greater than the third predetermined reference. The controller 7 is configured to control the vacuum motor 70 and the pump 80. The controller 7 is configured to stop the vacuum motor 70 and the pump 80 in response to receiving the third signal.

The cleaner may include the weight sensor 95 transmitting a fourth signal when the weight is lower than a fourth predetermined reference and the controller 7 controlling the notification unit 8 to output water quantity shortage information, upon receiving the fourth signal. In this case, the fourth predetermined level is a weight lower than the third predetermined reference. The fourth predetermined reference is a weight when water within the storage unit 30 rises to a water level lower than the point where the filter unit 60 is disposed in a state in which the storage unit 30 is horizontally placed. The fourth predetermined reference is a weight when water within the storage unit 30 rises to a water level higher than the point where the main pipe 51 is connected to a lower portion of the storage unit 30 in a state in which the storage unit 30 is horizontally placed. When a quantity of water is reduced to be lower than the fourth predetermined reference, water may not be normally supplied. Thus, when a quantity of water within the storage unit 30 is so small than the device cannot be normally operated, the user may be easily informed thereabout.

The weight sensor 95 is configured to sense a weight of water within the storage unit. The weight sensor 95 is configured to transmit the fourth signal based on the weight being lower than the fourth predetermined reference. The notification unit 8 is configured to output information from the cleaner. The controller 7 is configured to control the notification unit 8 to output water shortage information in response to receiving the fourth signal.

The third predetermined reference and the fourth predetermined reference may be set to the weight values in accordance with the water levels described above. The weight sensor 95 may be provided to supplementarily check a water level value sensed by the water level sensors 91 and 92 due to tilting of the device and transmit a corresponding signal to the controller 7.

Figure 14:
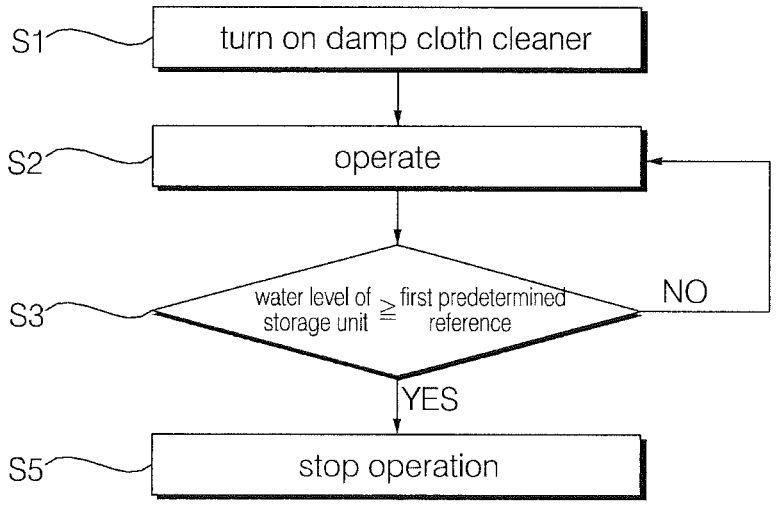
FIG. 14 is a flow chart illustrating an algorithm of a method for controlling a cleaner according to a sixth embodiment.
Figure 15:
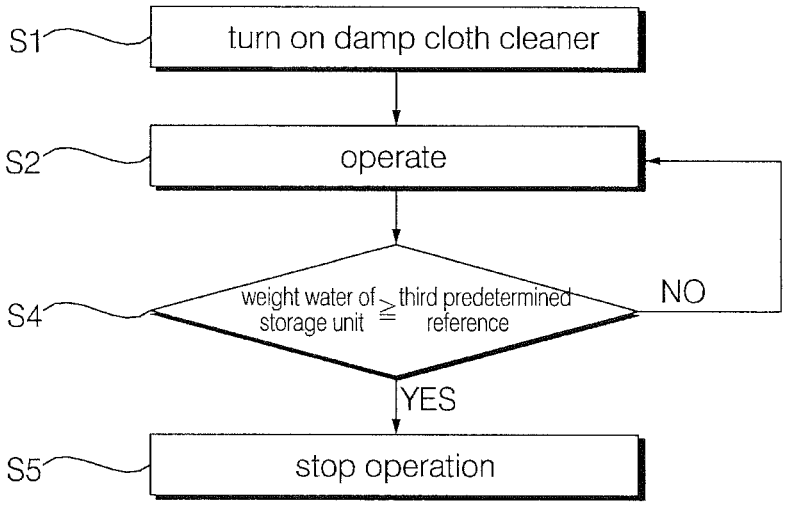
FIG. 15 is a flow chart illustrating an algorithm of a method for controlling a cleaner according to a seventh embodiment.
Figure 16:
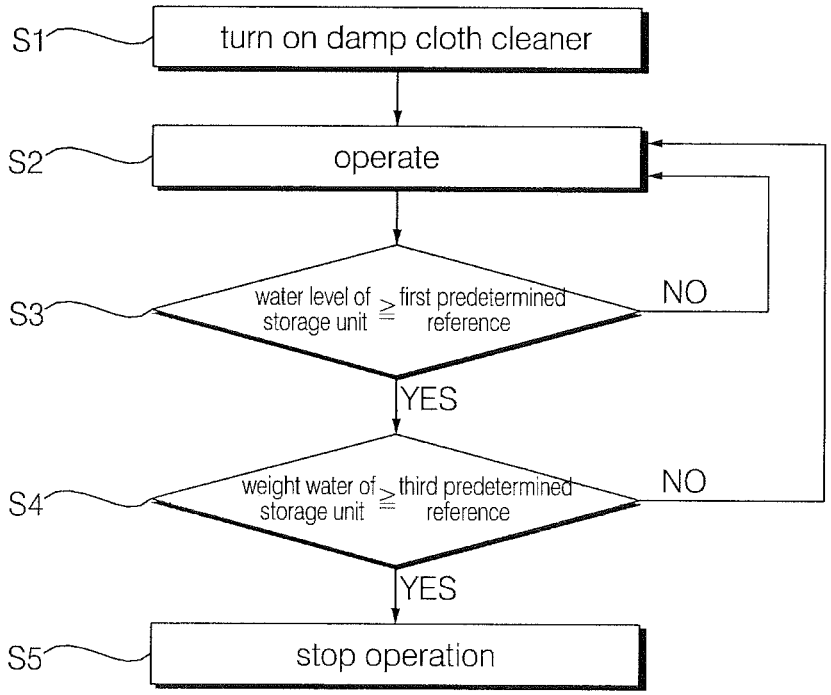
FIG. 16 is a flow chart illustrating an algorithm of a method for controlling a cleaner according to an eighth embodiment.

FIG. 14 is a flow chart illustrating an algorithm of a method for controlling a cleaner according to a sixth embodiment, FIG. 15 is a flow chart illustrating an algorithm of a method for controlling a cleaner according to a seventh embodiment, and FIG. 16 is a flow chart illustrating an algorithm of a method for controlling a cleaner according to an eighth embodiment.

Referring to FIGS. 14 to 16, a method for controlling a cleaner according to an embodiment of the present disclosure includes step S1 in which the cleaner is turned on and operated. That is, the user turns on the cleaner by the power switch (S1). The cleaner is activated (S1).

The control method includes step S2 in which the cleaner is operated, after the step S1 of turning on the cleaner. In the operation step S2, strength or speed of the vacuum motor 70, the pump 80, and the rotary motor 21 of the cleaner may be adjusted.

The control method may include a water level determining step S3 in which a water level within the storage unit 30 is sensed and whether the water level is equal to or higher than the first predetermined reference is determined, after the operation step S2.

The control method may include a weight determining step S4 in which a weight of water within the storage unit 30 is sensed and whether the weight is equal to or greater than the third predetermined reference is determined, after the operation step S2.

According to embodiments, the control method may include only any one of the water level determining step S3 and the weight determining step S4. The control method may include both the water level determining step S3 and the weight determining step S4, and in this case, the order of the water level determining step S3 and the weight determining step S4 may be interchanged. FIG. 16 illustrates a flow chart when the water level determining step S3 is performed before the weight determining step S4.

In the sixth embodiment (please refer to FIG. 14) in which the control method includes the water level determining step S3 and does not include the weight determining step S4, the control method may include a control step in which the operation of the cleaner is stopped (S5) when the water level is equal to or higher than the first predetermined reference and the operation of the cleaner is continuously performed (S2) when the water level is lower than the first predetermined reference, after the water level determining step (S3). Based on the sensed water level being equal to or higher than the first predetermined reference, the cleaner is deactivated. And, based on the sensed water level being lower than the first predetermined reference, the cleaner is continuously operated.

In the seventh embodiment (please refer to FIG. 15) in which the control method does not include the water level determining step S3 and includes the weight determining step S4, the control method may include a control step in which the operation of the cleaner is stopped (S5) when the water level is equal to or higher than the third predetermined reference and the operation of the cleaner is continuously performed (S2) when the water level is lower than the third predetermined reference, after the weight determining step (S4). Based on the sensed weight being equal to or greater than the third predetermined reference, the cleaner is deactivated. And, based on the sensed weight being lower than the third predetermined reference, the cleaner is continuously operated.

In the eight embodiment (please refer to FIG. 16) in which the control method includes both the water level determining step S3 and the weight determining step S4, the control method may include a control step in which the operation of the cleaner is stopped (S5) only when the water level is equal to or higher than the first predetermined reference and the weight is equal to or greater than the third predetermined reference and the operation of the cleaner is continuously performed (S2) when the water level is lower than the first predetermined reference or the weight is less than the third predetermined reference. Based on the sensed water level being equal to or higher than the first predetermined reference and based on the sensed weight being equal to or greater than the third predetermined reference, the cleaner is deactivated. And, Based on the sensed water level being lower than the first predetermined reference or based on the sensed weight being lower than the third predetermined reference, the cleaner is continuously operated.

Specific exemplary embodiments have been described. However, the present disclosure is not limited to the specific exemplary embodiments and various modifications may be made without departing from the scope of the present invention claimed in the claims, and such modifications should not be individually understood from technical concepts or prospects of the present disclosure.

What is claimed is:

1. A cleaner comprising:

a rotary plate;

a cloth that is attached to a bottom of the rotary plate and that is configured to receive water;

a rotation driver connected to an upper portion of the rotary plate and that is configured to rotate the rotary plate about an axis that is perpendicular to the rotary plate;

a container that stores water;

a water supplier that receives water from a lower portion of the container, that is configured to provide water to the cloth, and that includes:

a main pipe that is connected to the container and that is configured to guide water from the container to a center of the rotary plate; and a first dispersion pipe that is connected to the main pipe, that is configured to disperse water guided by the main pipe in a diameter direction of the rotary plate, and that defines a plurality of dispersion holes; and a pump that is configured to move water through the water supplier, wherein the rotary plate defines a plurality of supply holes that are configured to supply water to the cloth and defines a space that is configured to receive the first dispersion pipe, and wherein the plurality of supply holes are configured to communicate with the space.

2. The cleaner of claim 1, wherein:

the first dispersion pipe is located inside the rotary plate, the space is configured to allow rotation of the first dispersion pipe, and the rotary plate includes a rotational shaft that is perpendicular to the rotary plate, that is located on the upper portion of the rotary plate, that defines a through hole, and that is configured to receive the main pipe.

3. The cleaner of claim 1, wherein the water supplier includes additional dispersion pipes that are each connected to the main pipe, that are each rotationally symmetrical to the first dispersion pipe, and that each define a same angle between adjacent additional dispersion pipes.

4. The cleaner of claim 1, wherein the plurality of supply holes are located along lines that radiate from the center of the rotary plate.

5. The cleaner of claim 1, wherein a density of the plurality of supply holes decreases as a distance from the center of the rotary plate increases.

6. The cleaner of claim 1, wherein the cleaner includes:

a second water level sensor that is configured to sense a water level within the container, and that is configured to transmit a second signal based on the water level being lower than a second predetermined reference;

a notifier that outputs information from the cleaner; and a controller that is configured to control the notifier to output water shortage information in response to receiving the second signal.

7. The cleaner of claim 1, wherein the cleaner includes:

a weight sensor that is configured to sense a weight of water within the container, and that is configured to transmit a fourth signal based on the weight being lower than a fourth predetermined reference;

a notifier that outputs information from the cleaner; and a controller that is configured to control the notifier to output water shortage information in response to receiving the fourth signal.

8. The cleaner of claim 1, comprising:

a collector that collects water from the cloth and that is configured to provide water to an upper side of the container;

a filter unit that filters water that is collected by the collector; and a vacuum motor that moves water from the container through the collector.

9. The cleaner of claim 8, wherein the collector includes:

an outer partition that is located around a circumference of the rotary plate;

an inner partition that is located between the circumference of the rotary plate and the outer partition;

an intake that is located at the outer partition and that is configured to draw water into a gap that is located between the outer partition and the inner partition; and a collecting pipe that is configured to guide water that is received through the intake to the container.

10. The cleaner of claim 8, wherein:

the filter unit is located within the container and between the collector and the water supplier, and the container is configured to provide access to the filter unit through an openable structure.

11. The cleaner of claim 8, wherein the filter unit is located within the container and between the collector and the water supplier, and is removable from the container.

12. The cleaner of claim 8, wherein the filter unit is located within the container and between the collector and the water supplier, and includes a filter net that is configured to collect foreign objects in water and a filter frame that is configured to support the filter net, and the filter net is concave with respect to a top of the filter unit.

13. The cleaner of claim 8, wherein:

the filter unit includes a filter net that is configured to collect foreign objects in water and a filter frame that is configured to support the filter net, and the container further includes a guide rail that is configured to support the filter frame is located on an inner surface of the container.

14. The cleaner of claim 13, wherein:

the filter unit is removable from the container, and the guide rail is configured to guide and support the filter frame.

15. The cleaner of claim 8, wherein the cleaner includes:

a first water level sensor that is configured to sense a water level within the container and that is configured to transmit a first signal based on the water level being equal to or higher than a first predetermined reference; and a controller that is configured to control the vacuum motor and the pump and that is configured to stop the vacuum motor and the pump in response to receiving the first signal, wherein the first predetermined reference is a water level that is lower than a connection point of the container and the collector.

16. The cleaner of claim 8, wherein the cleaner includes:

a weight sensor that is configured to sense a weight of water within the container and that is configured to transmit a third signal based on the weight being equal to or greater than a third predetermined reference; and a controller that is configured to control the vacuum motor and the pump and that is configured to stop the vacuum motor and the pump in response to receiving the third signal.

17. The cleaner of claim 8, wherein:

the vacuum motor is located on an upper portion of the container, and the container includes:

an intake hole that is configured to communicate with the vacuum motor, a first partition that covers the intake hole and that extends from an inside side wall of the container toward an inside upper wall of the container, and a second partition that covers the first partition, that extends from the inside upper wall toward the inside side wall of the container, and that defines a gap with the inside side wall.

* * * * *